US008281867B2

(12) United States Patent
Belik

(10) Patent No.: US 8,281,867 B2
(45) Date of Patent: Oct. 9, 2012

(54) PIPE CONNECTION SYSTEM

(75) Inventor: Jaroslav Belik, Pearland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 283 days.

(21) Appl. No.: 12/682,532

(22) PCT Filed: Oct. 9, 2008

(86) PCT No.: PCT/US2008/079283

§ 371 (c)(1),
(2), (4) Date: Apr. 9, 2010

(87) PCT Pub. No.: WO2009/049006

PCT Pub. Date: Apr. 16, 2009

(65) Prior Publication Data

US 2010/0230115 A1 Sep. 16, 2010

Related U.S. Application Data

(60) Provisional application No. 60/979,002, filed on Oct. 10, 2007.

(51) Int. Cl.
*E21B 19/06* (2006.01)

(52) U.S. Cl. ..... 166/380; 166/77.51

(58) Field of Classification Search ..... 166/380, 166/77.1, 77.51

See application file for complete search history.

(56) References Cited

U.S. PATENT DOCUMENTS

| | | | | |
|---|---|---|---|---|
| 3,131,586 | A * | 5/1964 | Hart | 81/473 |
| 3,592,014 | A | 7/1971 | Brown | |
| 4,732,061 | A * | 3/1988 | Dinsdale | 81/57.34 |
| 4,843,945 | A * | 7/1989 | Dinsdale | 81/57.34 |
| 6,745,646 | B1 | 6/2004 | Pietras et al. | |
| 7,090,035 | B2 | 8/2006 | Lesko | |
| 7,114,235 | B2 * | 10/2006 | Jansch et al. | 29/464 |
| 7,132,127 | B2 | 11/2006 | Belik | |

FOREIGN PATENT DOCUMENTS

| | | | |
|---|---|---|---|
| JP | 11210374 | A | 8/1999 |
| WO | 03102350 | A2 | 12/2003 |

OTHER PUBLICATIONS

International Application No. PCT/US2008/079283 International Search Report and Written Opinion dated Apr. 30, 2009.

* cited by examiner

*Primary Examiner* — William P Neuder

(74) *Attorney, Agent, or Firm* — Conley Rose, P.C.

(57) ABSTRACT

A pipe connection system (200) includes a stationary support frame (202, 204) and a slip control system (300) coupled to the stationary support frame including a slip wedge (302) and at least one actuator (306, 308) coupled between the slip wedge and the stationary support frame, wherein the actuator is operable to move the slip wedge between a retracted position and an extended position in engagement with a downhole tubular string (118). A pipe connection system also includes a stationary support frame (202, 204), a slip control subsystem including a slip wedge moveable between a retracted position and an extended position in engagement with a downhole tubular string, a support frame subsystem (400) movably coupled to the stationary support frame, a stabbing arm subsystem (600) movably coupled to the moveable support frame subsystem, a thread lubricator subsystem (500) movably coupled to the moveable support frame subsystem, and a mud bucket subsystem (700) movably coupled to the moveable support frame subsystem.

32 Claims, 19 Drawing Sheets

PIPE CONNECTION SYSTEM

CROSS REFERENCE TO RELATED APPLICATIONS

This application is the U.S. National Stage under 35 U.S.C. §371 of International Patent Application No. PCT/US2008/079283 filed Oct. 9, 2008, which claims the benefit of U.S. Provisional Patent Application No. 60/979,002 filed Oct. 10, 2007, the disclosures of which are hereby incorporated herein by reference.

STATEMENT REGARDING FEDERALLY SPONSORED RESEARCH OR DEVELOPMENT

Not applicable.

BACKGROUND

In the hydrocarbon production industry, pipe strings are used in various stages of drilling and producing wells. Often times the pipe strings include series of pipe sections or single joints of pipe that are connected at their ends with pipe connections. The pipe connections often include threaded pin and box ends. When not in use, the pipe sections or joints may be disconnected and stored.

A number of different tubular members may be needed at a drilling rig, such as drill pipe, drill collars, and casing. During drilling of the well, for example, a storage area for vertical pipe sections or joints may be provided immediately adjacent the drilling rig or mast, or in horizontal storage areas outside of the rig. As the drilling pipe joints are needed, they are brought to the drill rig floor one at a time and added to the string. The process of connecting the pipe joints involves several steps.

First, slips are used to grip the drill string and suspend it at the rig floor, such as in the rotary table. The slips may include several wedge devices fitted around the drill string for gripping the drill string as the drill string is lowered. The slips are manually placed between the drill string and the rotary table by the rig crew, and the drill string is lowered by the driller. The open pipe connection end, or box end, at the top of the drill string may then be lubricated with pipe dope. Next, another pipe section or joint is transported from storage and positioned above the drill string. The pipe joint is manually manipulated such that the pin end of the pipe joint is stabbed into and made up with the drill string at the pipe connection. The lengthened drill string may then be lowered further into the well as the drill string is being tripped into the well.

Further, if the drill string is being tripped out of the well, successive pipe joint must be broken out from the drill string. The column of fluid in the pipe joint creates hydrostatic pressure. As the rig crew breaks out each pipe joint, a mud bucket may be manually disposed about the pipe connection to contain the hydrostatic pressure and capture or divert excess flow of mud from breakout. The significant hydrostatic pressure from breakout may cause problems with capturing or diverting excess mud flow, such as undesirable flex in the mud bucket.

The different steps in the pipe connection and disconnection process require different apparatus and manual efforts from the rig crew. The drill floor has a limited footprint, and crew members present on the floor presents safety concerns. The principles of the present disclosure are directed to overcoming one or more of the limitations of the existing apparatus and processes for tripping oilfield tubulars into and out of a well.

SUMMARY

An embodiment of a pipe connection system includes a stationary support frame and a slip control system coupled to the stationary support frame including a slip wedge and at least one actuator coupled between the slip wedge and the stationary support frame, wherein the actuator is operable to move the slip wedge between a retracted position and an extended position in engagement with a downhole tubular string. Some embodiments include a first actuator coupled to the stationary support frame, a support member coupled to the first actuator and slidably engaged with the slip wedge, an articulated arm coupled between the slip wedge and the stationary support frame, and a second actuator coupled between the articulated arm and the stationary support frame, wherein the second actuator is operable to rotate the articulated arm. Some embodiments include a moveable support frame coupled to the stationary support frame. Some embodiments include a pipe thread lubricator coupled to the moveable support frame. Some embodiments include a pair of stabbing arms coupled to the moveable support frame. Some embodiments include a mud bucket coupled to the moveable support frame.

An embodiment of a pipe connection system includes a stationary support frame, a slip control subsystem including a slip wedge moveable between a retracted position and an extended position in engagement with a downhole tubular string, a support frame subsystem movably coupled to the stationary support frame, a stabbing arm subsystem movably coupled to the moveable support frame subsystem, a thread lubricator subsystem movably coupled to the moveable support frame subsystem, and a mud bucket subsystem movably coupled to the moveable support frame subsystem. In some embodiments, each of the subsystems is a modular component removeable from the system. In some embodiments, each of the subsystems includes an actuator for automated movement of the subsystem.

An embodiment of a method for connecting a pipe joint to a downhole tubular string includes providing a pipe connection system on a rig floor adjacent the tubular string, extending a slip wedge into secured engagement with the tubular string, extending a support frame subsystem of the pipe connection system into a position adjacent the tubular string, extending a thread lubricator subsystem of the pipe connection system into a position adjacent a pipe thread of the tubular string and lubricating the pipe thread, positioning the pipe joint adjacent the tubular string, closing a pair of stabbing arms of the pipe connection system about the pipe joint, and making up the pipe joint with the tubular string. Some embodiments include retracting the thread lubricator subsystem, opening the stabbing arms, retracting the support frame subsystem, retracting the slip wedge, and operating the tubular string with the made up pipe joint. Some embodiments include re-extending the support frame subsystem, and closing a mud bucket subsystem of the pipe connection system about a pipe connection by re-closing the pair of stabbing arms.

An embodiment of a mud bucket for a pipe connection includes a first enclosure portion and a second enclosure portion, wherein the enclosure portions are moveable from an open position to receive the pipe connection to a closed position to surround the pipe connection, a first exit flow path to communicate mud in the closed position comprising an exit port and a vent conduit, and a second exit flow path to communicate mud in the closed position comprising an opening in at least one of the enclosure portions. Some embodiments include a first compartment in the first enclosure portion, and a second compartment in the second enclosure portion separate from the first compartment. In some embodiments, the first and second enclosure portions are seal-free in the closed position.

BRIEF DESCRIPTION OF THE DRAWINGS

For a more detailed description of the embodiments, reference will now be made to the following accompanying drawings.

DETAILED DESCRIPTION

Figure 1:
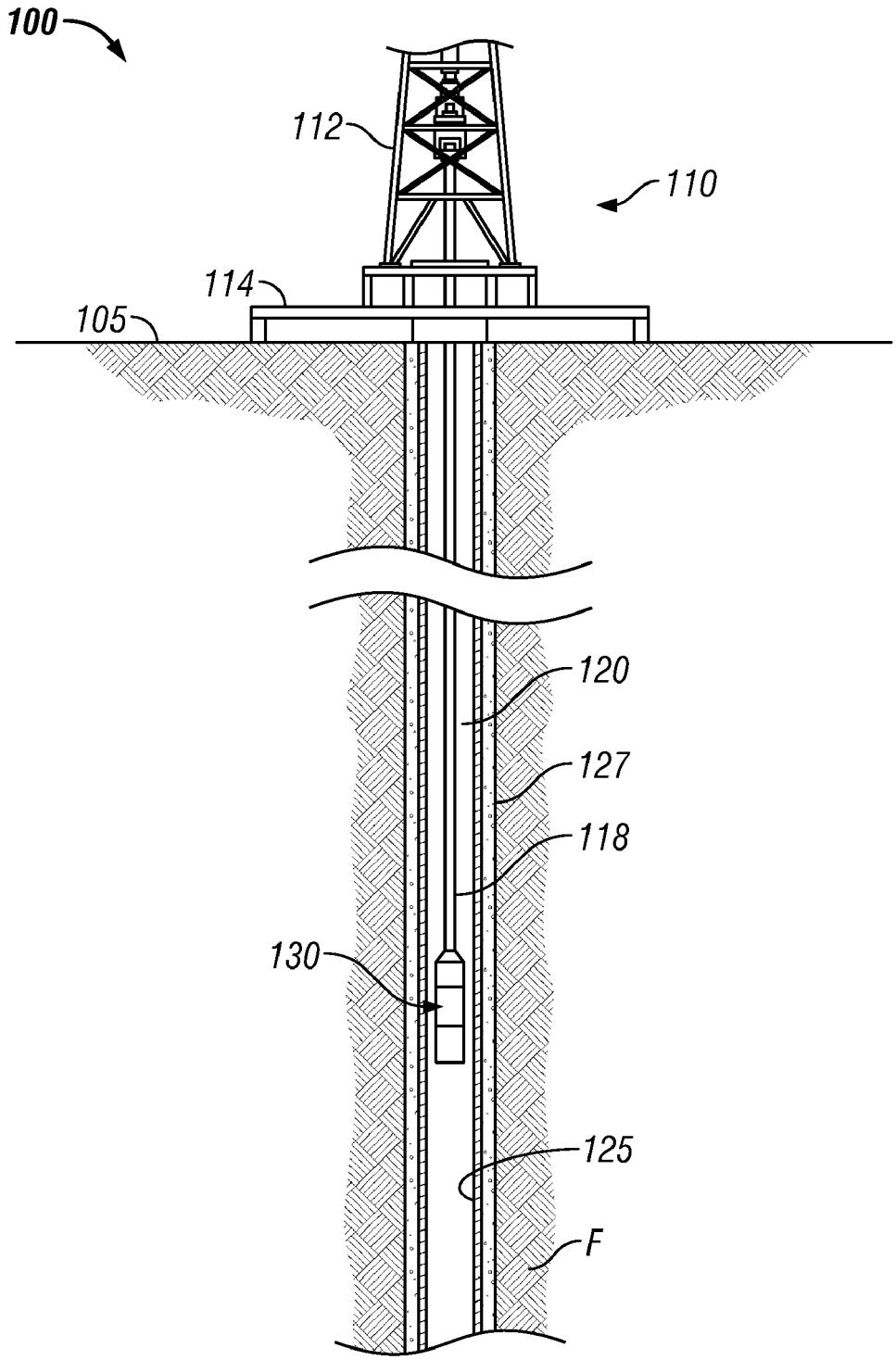
FIG. 1 shows a schematic elevation view in partial cross-section of an exemplary operating environment for a drilling system.

In the drawings and description that follow, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The principles of the disclosure are susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

Referring to FIG. 1, a schematic and partial cross-section representation of an exemplary operating environment for a drilling system 100 is shown. As disclosed herein, the drilling system 100 includes the use of various oilfield tubular members, such as drill pipe, drill collars and casing. The embodiments described herein will focus on drill pipe for ease and clarity of description. As depicted, a drilling rig 110 is positioned on the earth's surface 105 and extends over and around a well bore 120 that penetrates a subterranean formation F for the purpose of recovering hydrocarbons. The well bore 120 may be drilled into the subterranean formation F using conventional (or future) drilling techniques and may extend substantially vertically away from the surface 105 or may deviate at any angle from the surface 105. In some instances, all or portions of the well bore 120 may be vertical, deviated, horizontal, and/or curved.

At least the upper portion of the well bore 120 may be lined with casing 125 that is cemented 127 into position against the formation F in a conventional manner. Alternatively, the drilling environment includes an uncased well bore 120. The drilling rig 110 includes a derrick 112 (or mast, for example) with a rig floor 114 through which a work string 118, such as a jointed pipe drill string, extends downwardly from the drilling rig 110 into the well bore 120. The work string 118 suspends a representative bottom hole assembly 130 to a depth within the well bore 120 to perform a specific operation, such as drilling the well bore with a drill bit. The drilling rig 110 is conventional and therefore includes a motor driven winch and other associated equipment for extending the work string 118 into the well bore 120.

While the exemplary operating environment depicted in FIG. 1 refers to a stationary drilling rig 110 for lowering the drill string 118 within a land-based well bore 120, one of ordinary skill in the art will readily appreciate that mobile workover rigs could also be used to lower the work string 118 into the well bore 120. It should be understood that the system 100 may also be used in other operational environments, such as with an offshore well bore.

Figure 2:
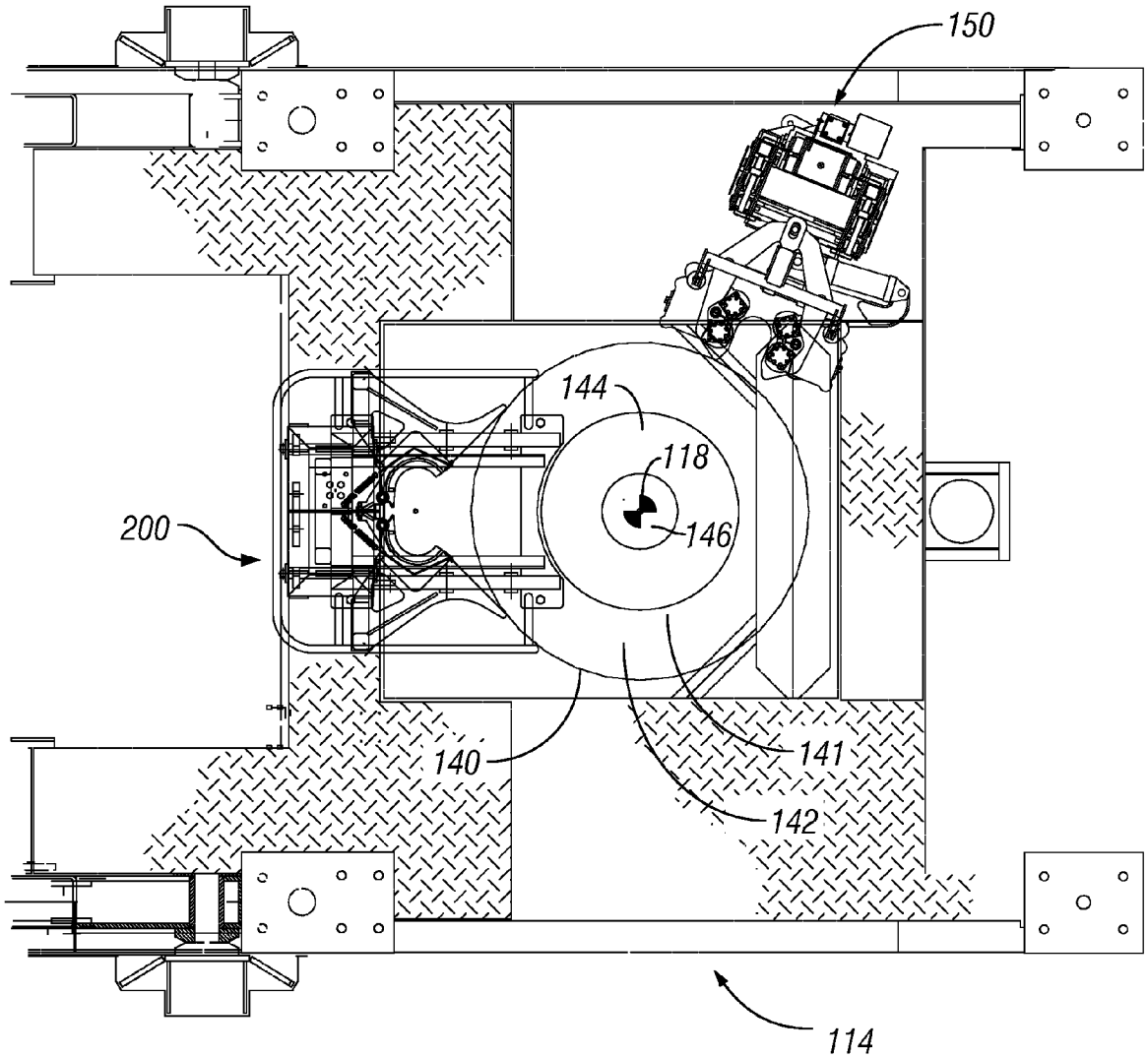
FIG. 2 shows a top view of a rig floor supporting an embodiment of a pipe connection and disconnection system.

Referring now to FIG. 2, a top view of the drill rig floor 114 is shown including an embodiment of a pipe connection and disconnection system 200. The pipe connection system 200 is disposed adjacent a rotary table 140 having a well 141 with tapered side walls 142, a bottom surface 144 and an opening 146 to receive the drill string 118. Also disposed adjacent the rotary table 140 is an iron roughneck 150. Other devices, apparatus, and structures may also be present on the rig floor 114.

Figure 3:
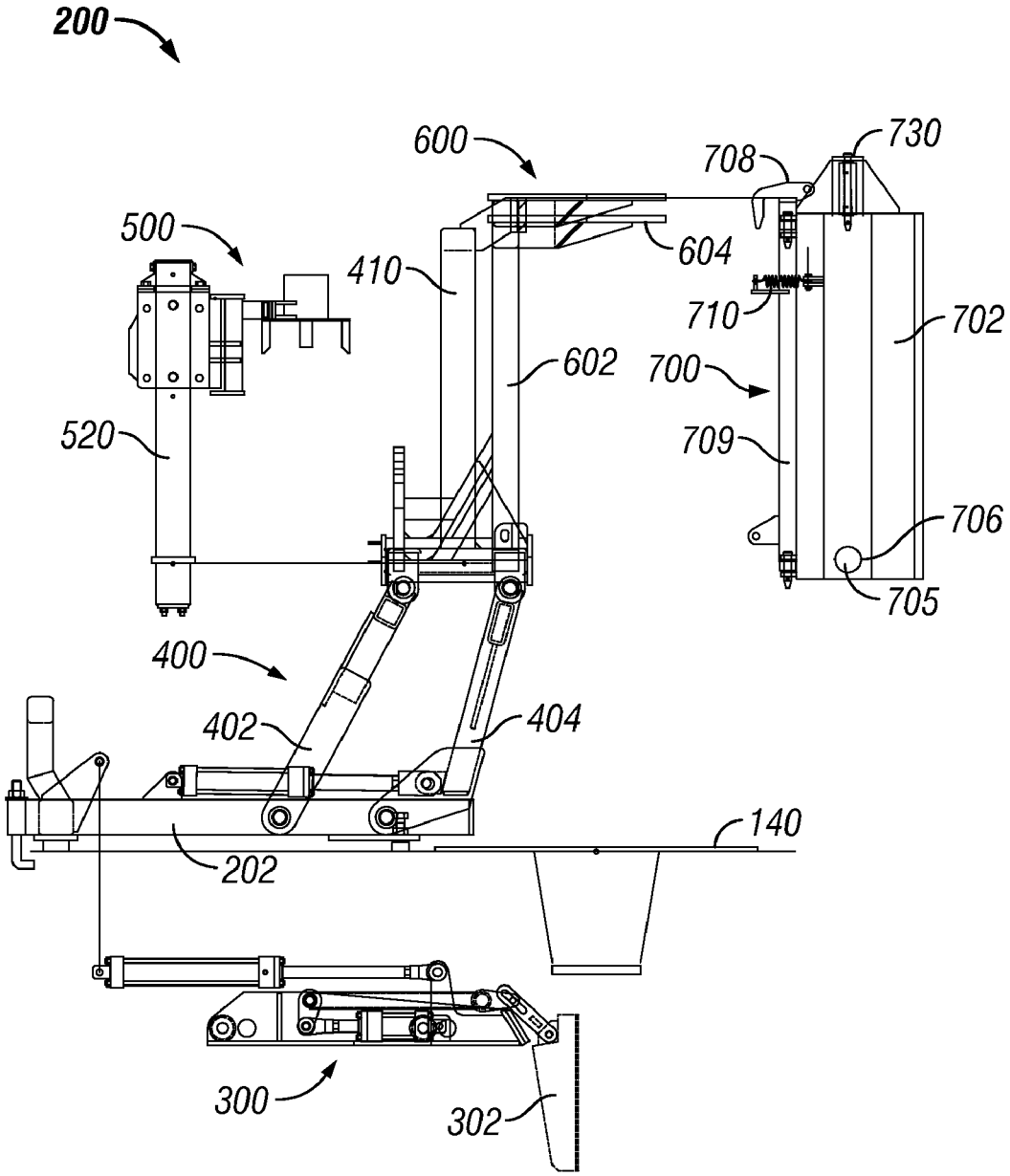
FIG. 3 shows a side, exploded view of the pipe connection system of FIG. 2.

Referring next to FIG. 3, a side, exploded view of the pipe connection system 200 is shown. In exemplary embodiments, the system 200 is modular, and the different subsystems or components described herein may be arranged in different combinations to provide varying functionality to the system 200. A first subsystem or component is a slip control subsystem 300 with slip wedge 302. A second subsystem or component is a moveable frame subsystem 400 coupled to a horizontal support member 202 via moveable pivot arms 402, 404 and including a frame 410. A third subsystem is a lubricator 500 supported by a column 520. A fourth subsystem is a stabbing subsystem 600 having stabbing arms 602 with jaws 604. A fifth subsystem is a mud bucket subsystem 700. The subsystems 300, 500, 700 are shown exploded from their operating positions in the primary support subsystems 400, 600.

Figure 4B:
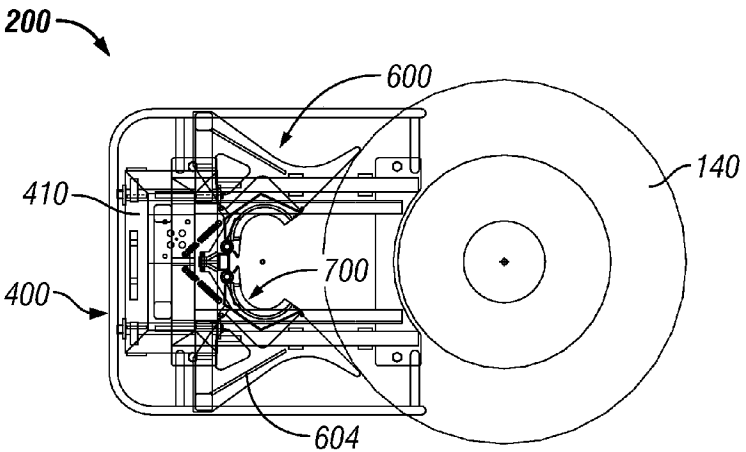
FIG. 4B shows a top view of the pipe connection system of FIG. 4A.
Figure 4A:
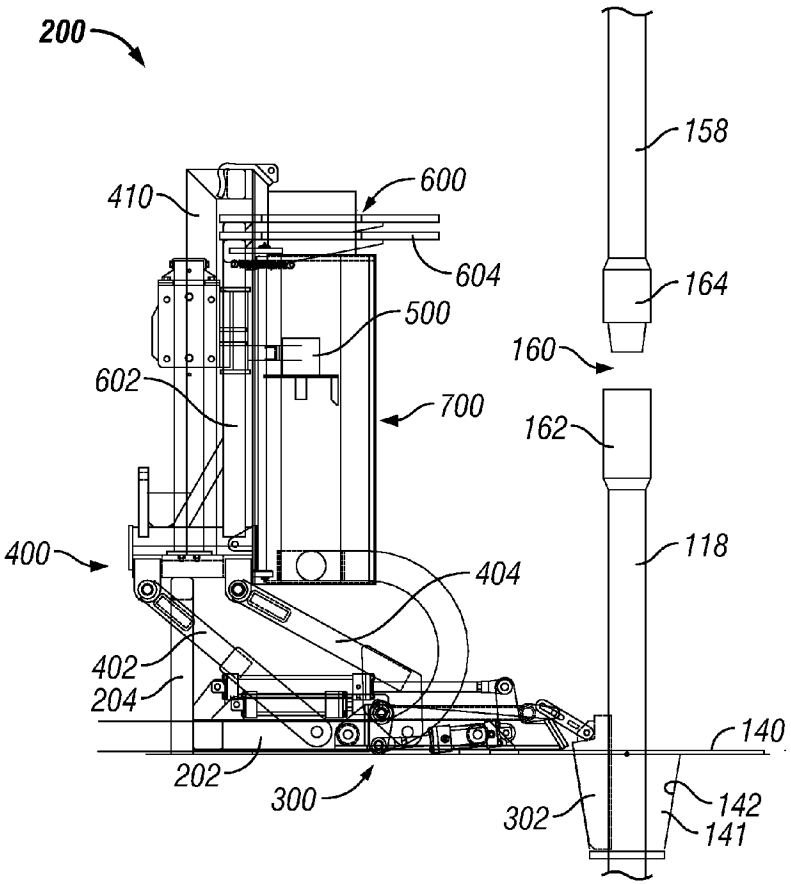
FIG. 4A shows a side view of an embodiment of an assembled and operational pipe connection system.

Referring next to FIG. 4A, a side view of an embodiment of an assembled pipe connection system 200 is shown in a retracted position relative to the drill string 118 and the rotary table 140 (except the slip control system 300, which is shown extending the slip wedge 302). The slip control subsystem 300 is disposed atop the rig floor and adjacent the rotary table 140, and coupled to the horizontal support member 202. The moveable frame subsystem 400 is coupled to the horizontal support member 202 via moveable pivot arms 402, 404 and includes the frame 410. The frame 410 may variously support additional subsystems. For example, the frame 410 supports the lubricator 500, the stabbing system 600, and the mud bucket system 700 as shown. The system 200 is operable to interact with the drill string 118 and a pipe joint 158 to manipulate the connection ends 162, 164 to connect and disconnect the pipe joint 158 with the drill string 118 at the connection 160.

Referring now to FIG. 4B, a top view of the pipe connection system 200 is provided showing the moveable frame system 400 and the frame 410, the stabbing system 600, and the mud bucket system 700. The frame system 400 and the stabbing system 600 are retracted relative to the rotary table 140.

Figure 4C:
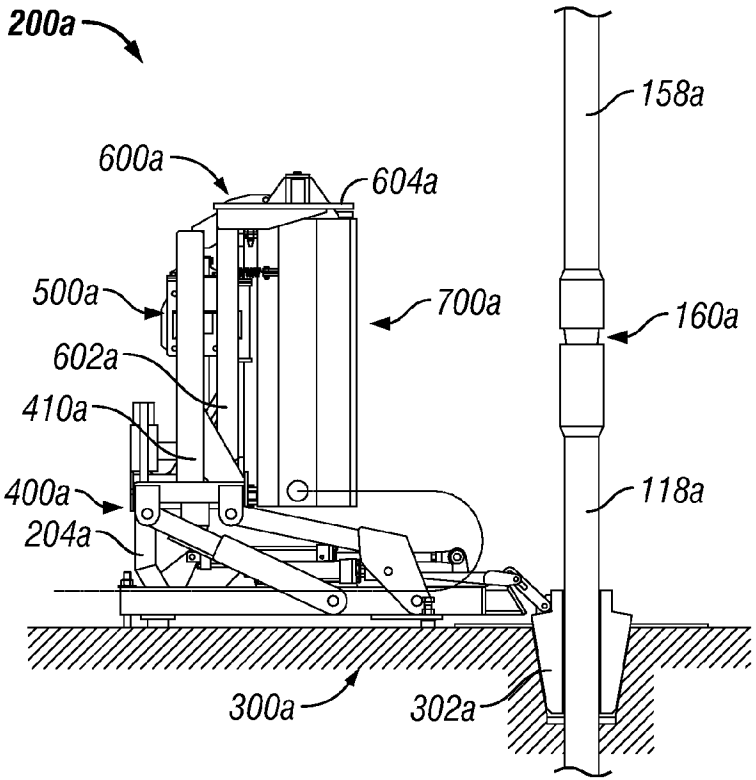
FIG. 4C shows a side view of an additional embodiment of the pipe connection system of FIG. 4A.

Referring to FIG. 4C, a side view of an additional embodiment of a pipe connection system 200*a* is shown. The system 200*a* of FIG. 4C includes subsystems 300*a*, 400*a*, 500*a*, 600*a*, 700*a* similar to the subsystems 300, 400, 500, 600, 700 illustrated and described with reference to FIGS. 4A and 4B, with certain lines removed for clarity and certain components revised slightly, such as the support 204*a* and the frame 410*a*.

Figure 5A:
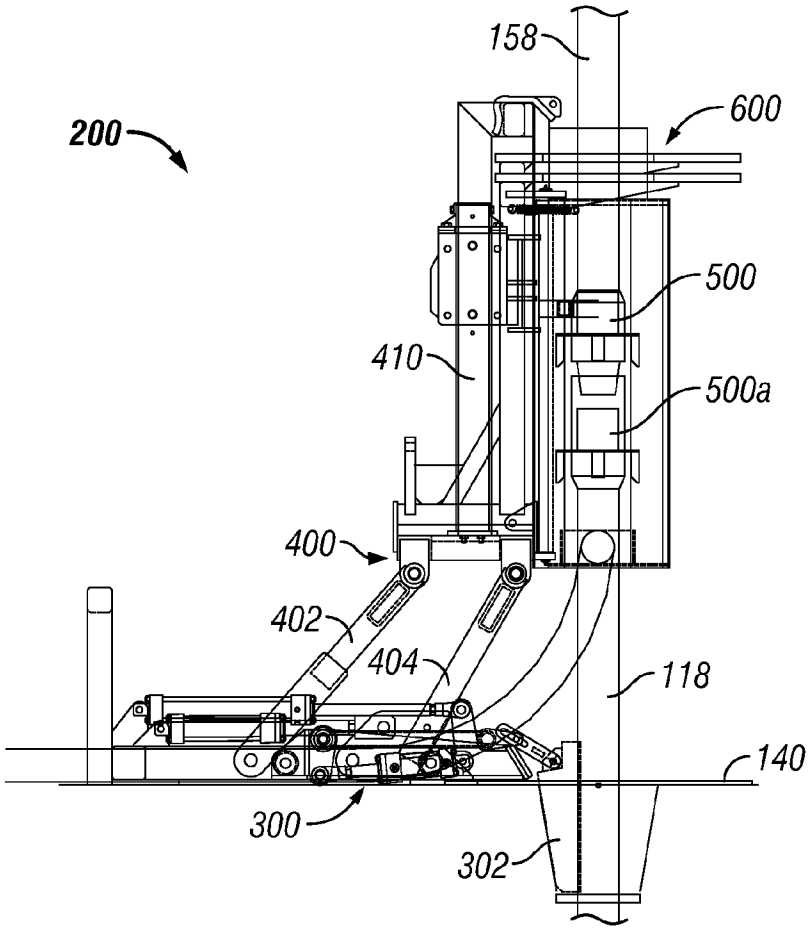
FIG. 5A shows a side view of the pipe connection system of FIG. 4A in an extended position.

Referring now to FIG. 5A, a side view of the pipe connection system 200 is shown in an extended position. The moveable arms 402, 404 have been actuated to move the frame 410 closer to the drill string 118 and pipe joint 158. As a result, the lubricator 500 (e.g., a pipe thread lubricator), the stabbing system 600, and the mud bucket system 700 are placed near the drill string 118 and the pipe joint 158 to interact with same as detailed elsewhere herein. The slip control system 300 is engaged with the drill string 118 to stabilize it.

Figure 5C:
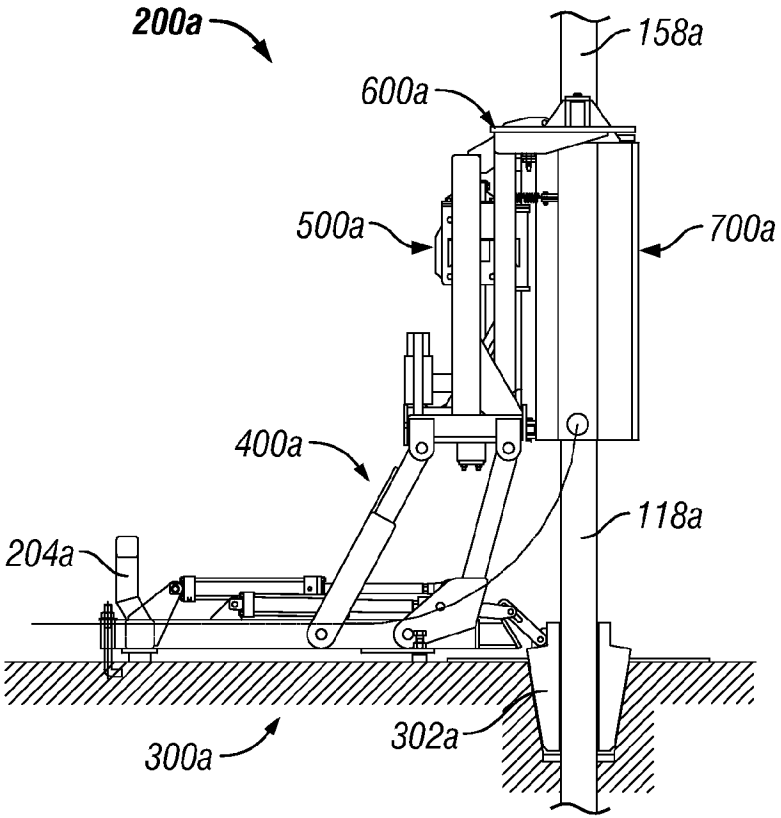
FIG. 5C shows a side view of the pipe connection system of FIG. 4C in an extended position.
Figure 5B:
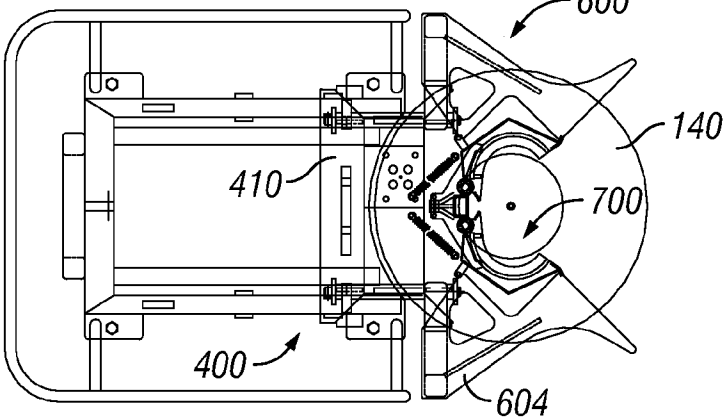
FIG. 5B shows a top view of the pipe connection system of FIG. 5A.

Referring now to FIG. 5B, a top view of the extended pipe connection system 200 is provided, showing the moveable frame system 400 and the frame 410, the stabbing system 600, and the mud bucket system 700 in position to interact with the drill string 118 and the pipe joint 158.

Referring to FIG. 5C, a side view of the pipe connection system 200*a* of FIG. 4C is shown in the extended position. The system 200*a* includes components similar to those illustrated and described with reference to FIGS. 5A and 5B, with slight changes as previously noted.

Figure 6A:
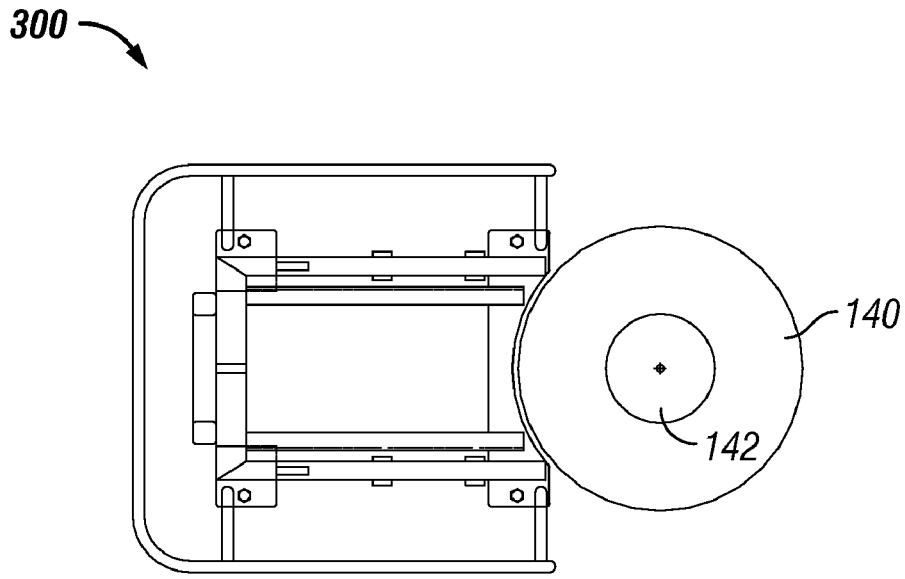
FIG. 6A shows a top view of an embodiment of a slip control subsystem isolated from the pipe connection system.

Referring next to FIGS. 6A-6D, an embodiment of the slip control subsystem 300 is shown and described in more detail and separate from the remainder of the pipe connection system 200. In FIG. 6A, a top view of the slip control system 300 is shown adjacent the rotary table 140.

Figure 6B:
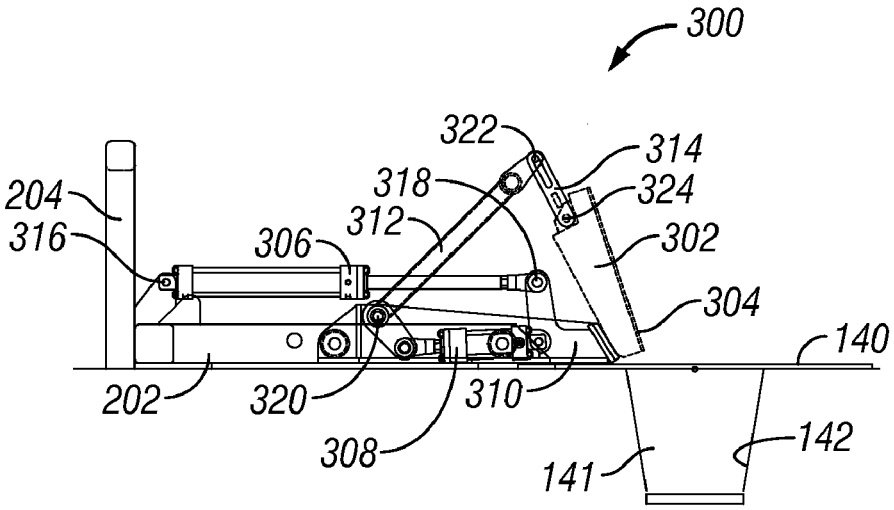
FIG. 6B shows a side view of the slip control subsystem of FIG. 6A at a beginning stage of operation.

In FIG. 6B, a side view of the slip control system 300 shows the system 300 at a beginning stage of positioning a slip wedge 302 for use in the rotary table 140. The system 300 includes a first actuator 306, a second actuator 308, a wedge support member 310, a first pivot arm 312, and a second pivot arm 314 (together, the arms 312, 314 form an articulated arm having an intermediate joint). The actuators may, for example, be hydraulic piston and cylinder arrangements, or other conventional mechanisms for actuating adjacent moveable members as described herein. The first actuator 306 is coupled to the stationary support frame 202, 204 at coupling point 316, and coupled to the wedge support member 310 at the coupling point 318. The first and second pivot arms 312, 314 include a first coupling pivot point 320, a second coupling pivot point 322 and a third coupling pivot point 324.

Figure 6C:
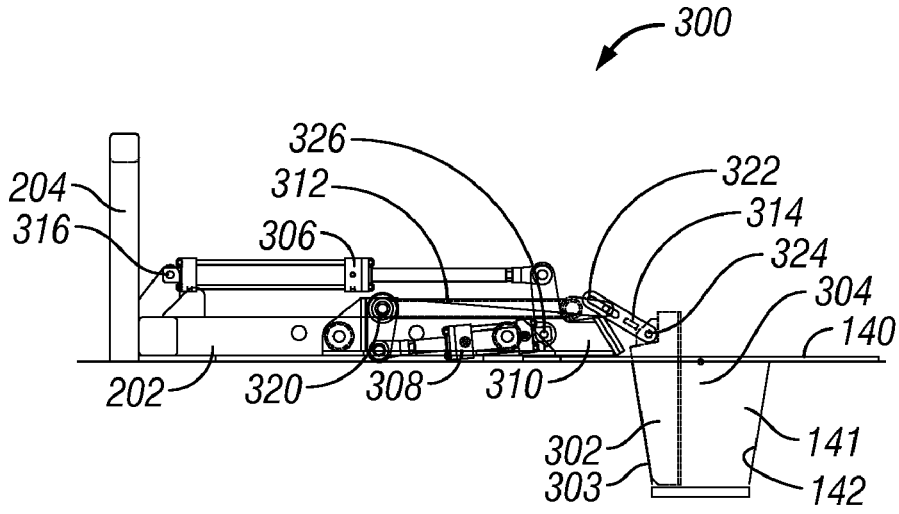
FIG. 6C shows a side view of the slip control subsystem of FIG. 6A in an extended position.

As shown in FIG. 6B, the slip control system 300 is in a first extended position wherein the actuator 306 is extended and the actuator 308 is retracted to rotate the pivot arm 312 about pivot point 320 as shown. When it is desired to place the slip wedge 302 for engagement and operation with the drill string, the actuator 308 is actuated to an extended position as shown in FIG. 6C. The actuator 308 rotates the pivot arm 312 about the pivot point 320 while the angled support member 310 slidably guides the slip wedge 302 into the well 141 of the rotary table 140. As the wedge 302 is lowered into the well 141, the pivot arm 314 rotates about the pivot point 322 and the pivot point 324 to give the wedge 302 flexibility of movement. The final extended position of the slip control system 300 and the wedge 302 is shown in FIG. 6C. The engaging face 304 and tapered back surface 303 of the wedge 302 operate in a conventional manner to grip and suspend the drill string.

Figure 6D:
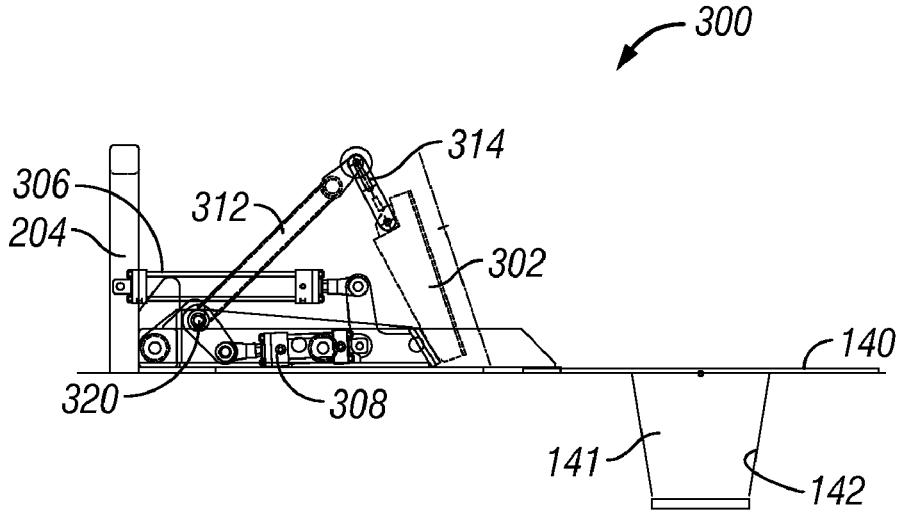
FIG. 6D shows a side view of the slip control subsystem of FIG. 6A in a retracted position.

After use, the slip wedge 302 is disengaged from the drill string in a conventional manner and must be removed from the well 141. Referring to FIG. 6D, the actuator 308 is retracted to rotate the arm 312 about the pivot point 320 and pull the slip wedge up and out of the well 141. The actuator 306 is then retracted to pull the slip control system back to its retracted position as shown in FIG. 6D.

Figure 7A:
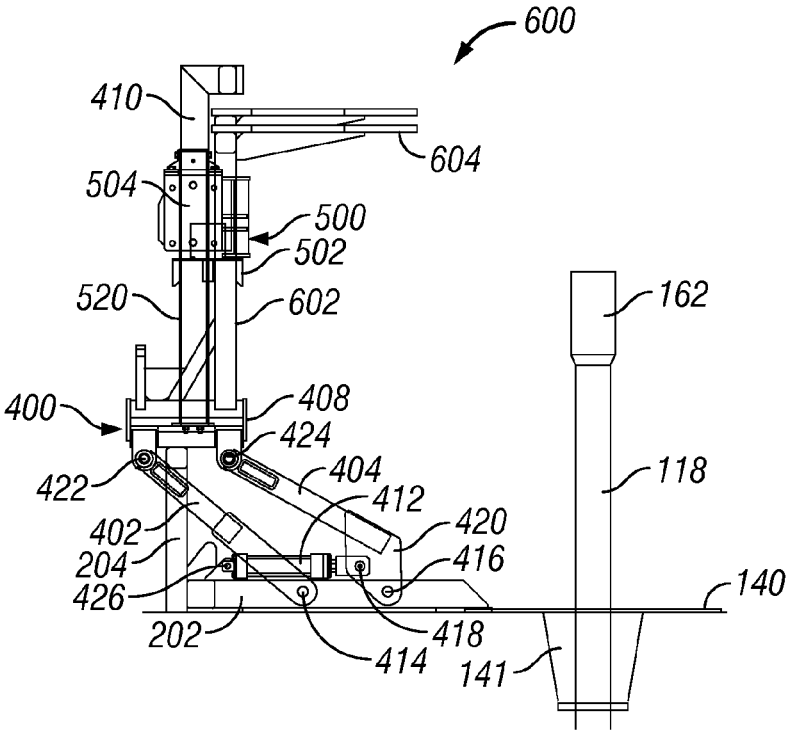
FIG. 7A shows a side view of an embodiment of a moveable frame subsystem, a thread lubricator subsystem and a stabbing subsystem isolated from the pipe connection system and in a retracted position.

Referring now to FIGS. 7A-7F, portions of the pipe connection system 200 are isolated to illustrate embodiments of the thread lubricator 500 and their operation. In FIG. 7A, a side view of the moveable frame system 400 supporting the thread lubricator 500 and support column 520 is shown in a retracted position. The moveable frame system 400 includes the first moveable pivot arm 402 coupled to the horizontal support member 202 at a coupling pivot point 414. The second moveable pivot arm 404 includes a rotating drive member 420 coupled to the support member 202 at a coupling pivot point 416. The rotating drive member 420 includes a coupling pivot point 418 connected to an actuator 412 (consistent with other actuators described herein) that is coupled to the support member 202 at the pivot point 426. The moveable arms 402, 404 are coupled to a base portion 408 of the frame 410 at coupling pivot points 422, 424, respectively. The base portion 408 rests atop the vertical support member 204. The frame 410 supports a thread lubricator 500 as shown, the lubricator 500 including a dolly 504 moveably coupled to the column 520 and an applicator 502 coupled to and interacting with the dolly 504. In some embodiments, the assembly as shown in FIG. 7A includes the stabbing system 600 having stabbing arms 602 and jaws 604.

In some embodiments, an exemplary thread lubricator 500 includes a centrifugal pipe dope applicator as disclosed in U.S. Pat. No. 7,132,127 issued to Belik. In these embodiments, the thread lubricator 500 and its components are consistent with the centrifugal pipe dope applicator and its components as disclosed in U.S. Pat. No. 7,132,127. In other embodiments, further pipe dope applicator systems may be used.

Figure 7B:
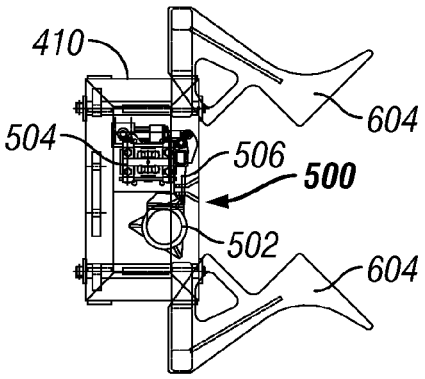
FIG. 7B shows a top view of the subsystems of FIG. 7A.
Figure 7C:
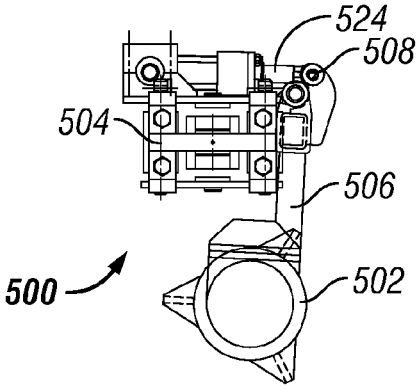
FIG. 7C shows an isolated view of the thread lubricator subsystem of FIG. 7B.

Referring now to FIGS. 7B and 7C, top views of portions of the system in FIG. 7A are shown. In FIG. 7B, the lubricator 500 is shown in a retracted position wherein the stabbing jaws 604 are open and the applicator 502 is drawn close to the frame 410 and the dolly 504 by the moveable pivot arm 506. In FIG. 7C, the dolly 504 is coupled to the applicator 502 via an actuator 524, a coupling pivot point 508 and the pivot arm 506. The actuator 524 is extended to retract the arm 506. In some embodiments, certain components such as the dolly 504 and the arm 506 include conduits and lines to communicate pipe dope and power with a source located apart from the system shown. The applicator system source is consistent with that disclosed in U.S. Pat. No. 7,132,127 and other applicator systems.

Figure 7D:
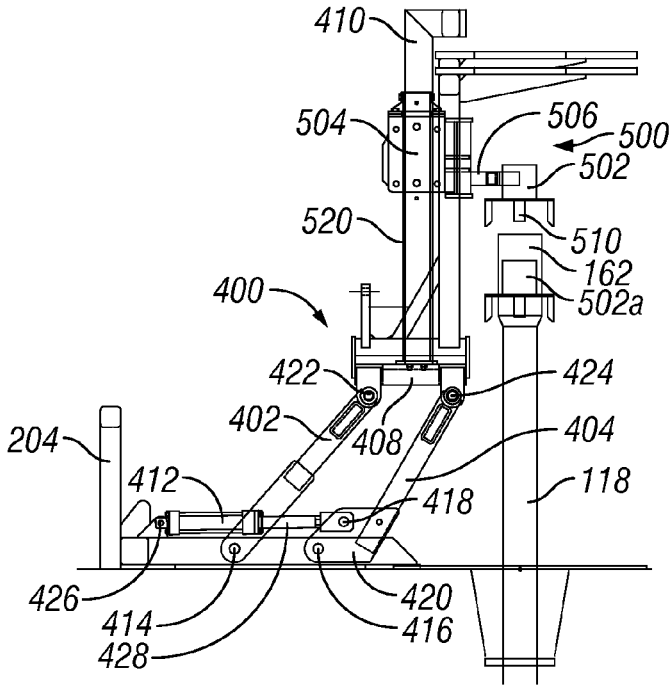
FIG. 7D shows the subsystems of FIG. 7A in an extended position.

When it is desired to apply lubrication or pipe dope to the connection end 162 of drill string 118, for example, the frame system 400 may be actuated and moved as described below with reference to FIGS. 7D-7F. Referring first to FIG. 7D, the actuator 412 is actuated such that a piston 428 extends away from the support member 204. A force is applied to the rotating drive member 420 at the pivot point 418, resulting in rotation of the drive member 420 about the pivot point 416. The pivot arm 404 is guided by the rotation of the drive member 420 and supports the frame base 408 at the pivot point 424. As the pivot arm 404 guides the frame base 408 to the extended position shown in FIG. 7D, the pivot arm 402 provides additional support to the base 408 via pivot points 414, 422. The coupling pivot point 426 allows the actuator 412 to rotate as the frame system 400 goes through its range of motion.

As shown in FIG. 7D, the extended position of the moveable frame system 400 places the thread lubricator 500 adjacent the connection end 162 of the drill string 118. To position the applicator 502 more precisely within the connection end 162, where threads may be located, an actuator in the dolly 504 moves the pivot arm 506 and applicator 502 away from the frame 410 and over the connection end 162. The dolly 504 may then be actuated to move down along the column 520 to lower the applicator 502 and an applicator tip 510 into the connection end 162. The applicator tip 510, for example, may include a centrifugal drum as disclosed in U.S. Pat. No. 7,132,127, and pipe dope may be applied to the threads in the connection end 162 as also disclosed therein. The thread lubricator 500 is moveable to a plurality of positions along the column 520 to adjust to the variable heights of the connection end with respect to the rig floor, another of such positions being represented by an applicator 502*a*.

Figure 7E:
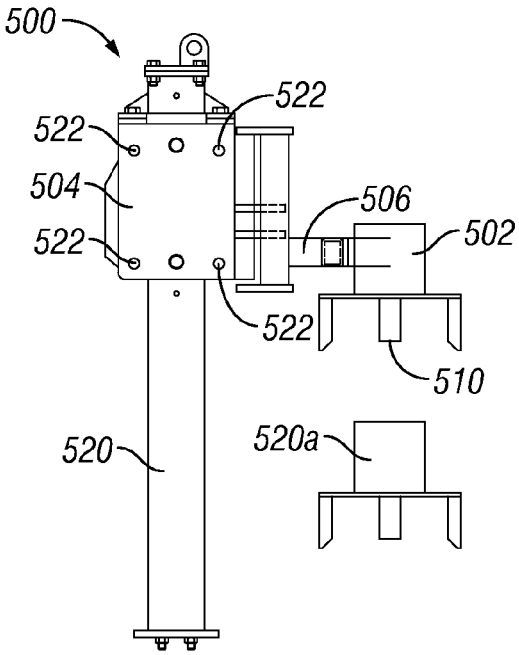
FIG. 7E shows an isolated view of the thread lubricator subsystem of FIG. 7D.
Figure 7F:
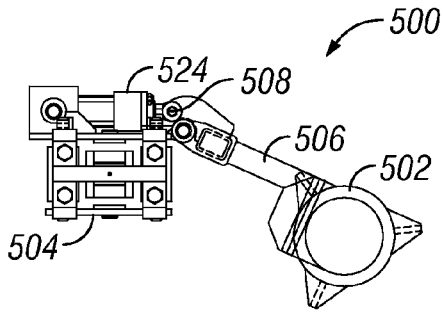
FIG. 7F shows a top view of the thread lubricator subsystem of FIG. 7E.

Referring now to FIG. 7E, an isolated and enlarged side view of the extended thread lubricator 500 is shown. The dolly 504 is moveably coupled to the column 520 via rollers disposed internally of the dolly 504 generally at positions 522. A hydraulic cylinder may be placed internal to the column 520 to assist with movement of the dolly 504. The applicator 502 is extended from the housing 504 by the pivot arm 506. The applicator 502 is moveable by the rollers in dolly 504 to another position along the column 520 at the applicator 502*a*. As shown in the top view of FIG. 7F, the applicator 502 is extended away from the housing 504 by retracting the actuator 524 and rotating the pivot arm 506 about the coupling pivot point 508.

Figure 8B:
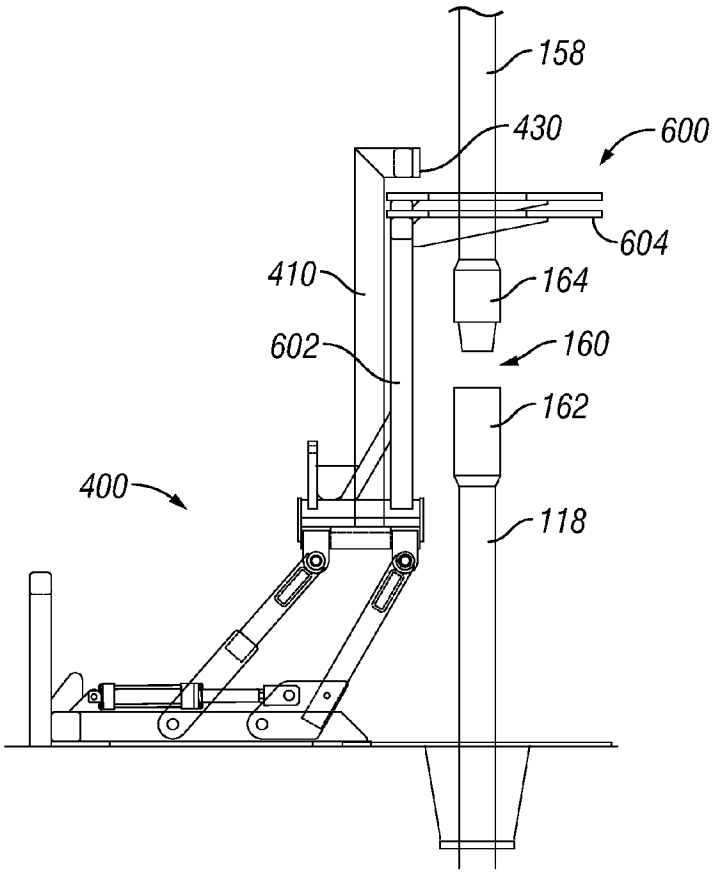
FIG. 8B shows the subsystems of FIG. 8A in an extended position.
Figure 8A:
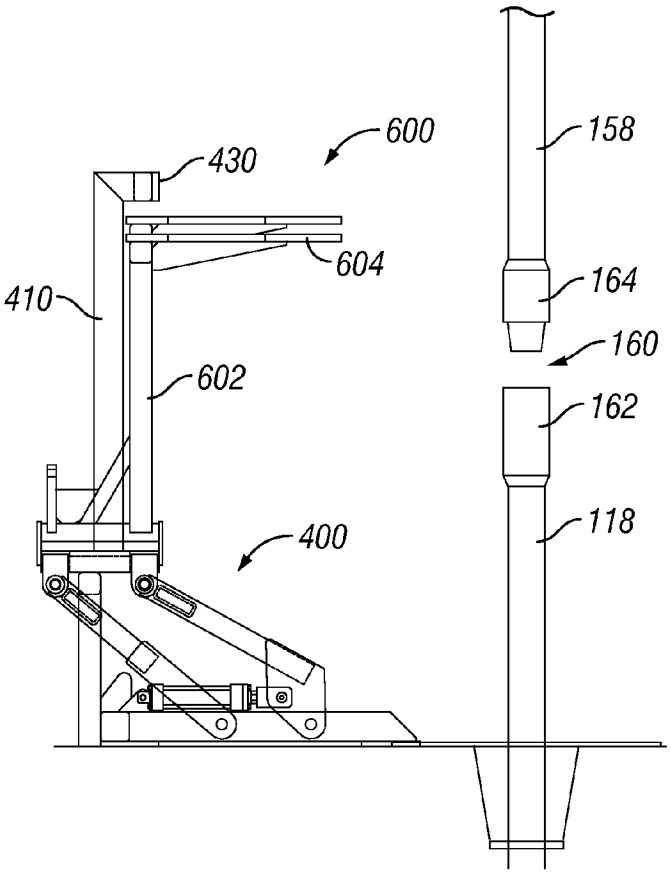
FIG. 8A shows a side view of an embodiment of the moveable frame subsystem and the stabbing subsystem isolated from the pipe connection system and in a retracted position.
Figure 8D:
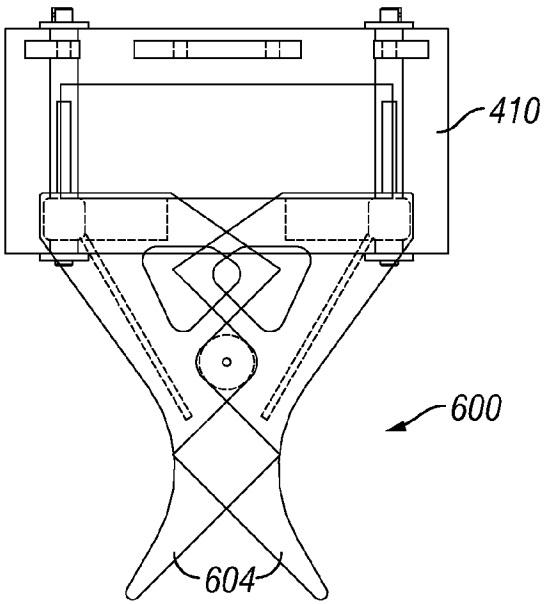
FIG. 8D shows a top view of the stabbing subsystem in a closed position.
Figure 8C:
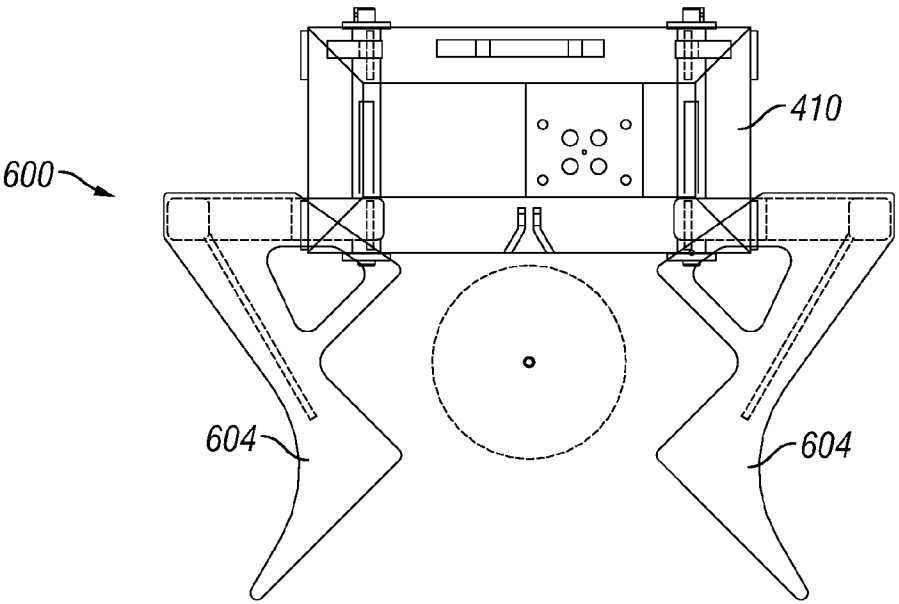
FIG. 8C shows a top view of the stabbing subsystem in an open position.

Referring now to FIGS. 8A-8F, embodiments of the system are shown including the moveable frame system 400 and the stabbing system 600 isolated from other parts of the connection system 200. Referring first to FIG. 8A, the moveable frame system 400 is retracted relative to the drill string 118 and the pipe joint 158 as previously disclosed. When it is desired to stab the pipe joint 158 into the drill string 118, such as during make up, or stab the pipe joint 158 out of the drill string 118, such as during break out, the moveable frame system 400 is actuated as previously disclosed to extend the system toward the pipe joint 158 and drill string 118 as shown in FIG. 8B. The stabbing system 600 is in an open position, as shown in the top view of FIG. 8C, wherein the stabbing jaws 604 are spaced apart from each other adjacent the frame 410. In FIG. 8D, the stabbing jaws 604 are moved together to surround and engage a pipe joint. The frame 410 may include a bumper 430 for contacting a pipe joint during system extension.

Figure 8F:
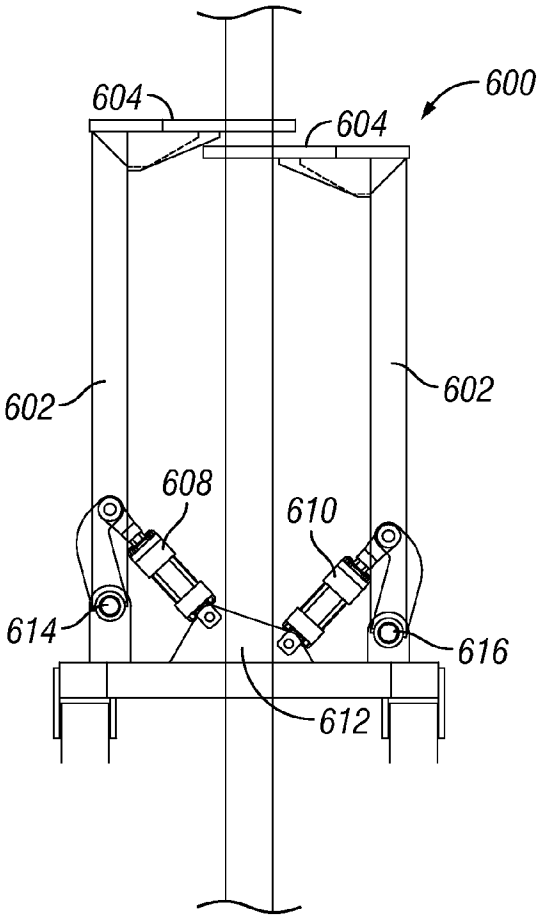
FIG. 8F shows a front view of the stabbing subsystem of FIG. 8D.
Figure 8E:
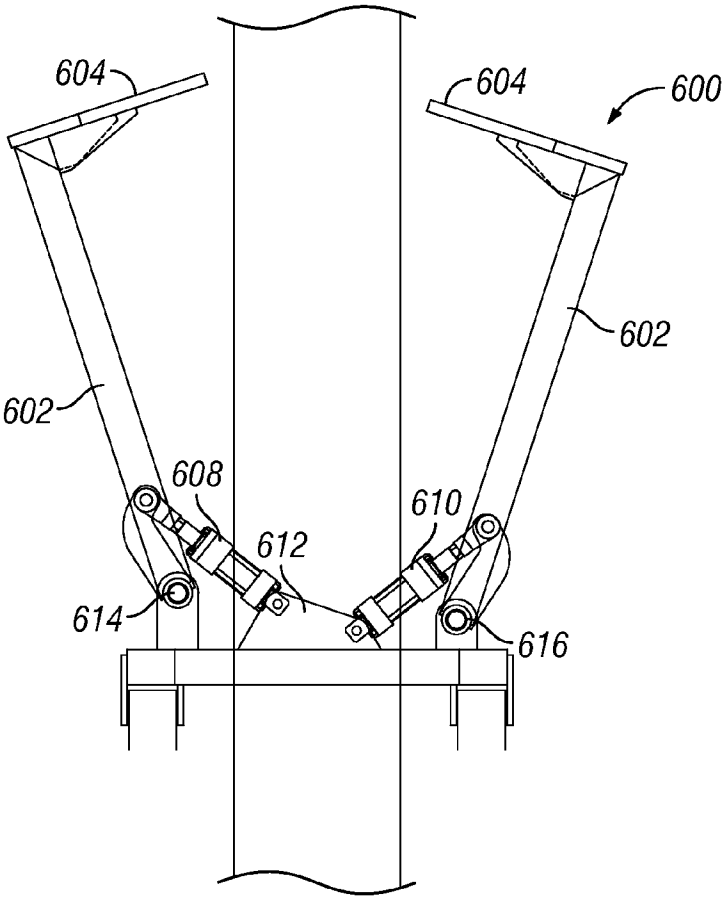
FIG. 8E shows a front view of the stabbing subsystem of FIG. 8C.

Referring to FIG. 8E, a front view of the stabbing system 600 includes an actuator 608 coupled to a mount 612 and the stabbing arm 602, and another actuator 610 coupled to the mount 612 and the other stabbing arm 602. The actuators 608, 610 are extended to open the stabbing jaws 604. As shown in FIG. 8F, the actuators 608, 610 are retracted to rotate the stabbing arms 602 about pivot points 614, 616 and close the stabbing jaws 604.

Figure 9B:
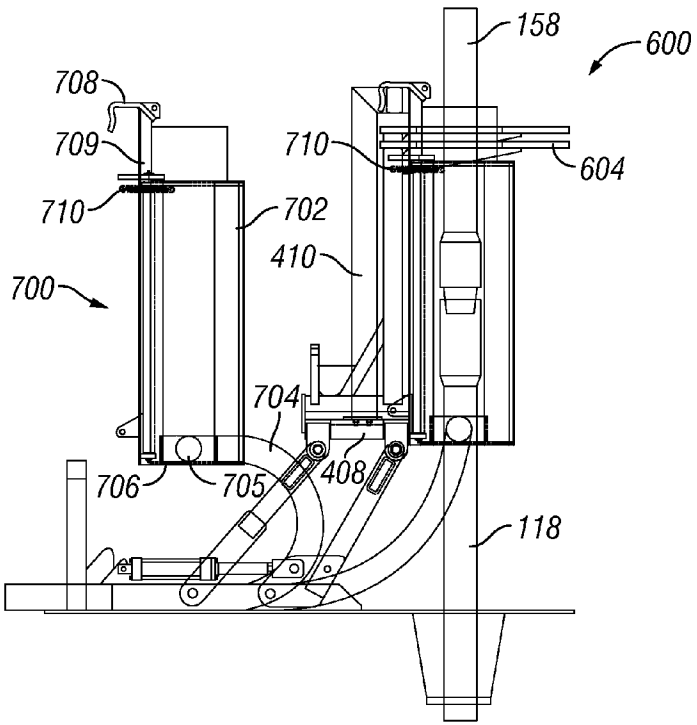
FIG. 9B shows the subsystems of FIG. 9A in an extended position.
Figure 9A:
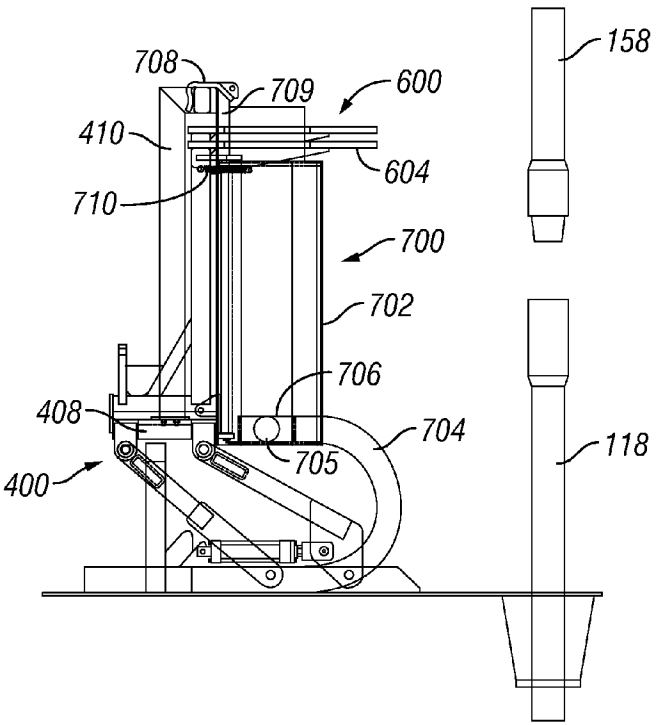
FIG. 9A shows a side view of an embodiment of the moveable frame subsystem, the stabbing subsystem and a mud bucket subsystem isolated from the pipe connection system and in a retracted position.
Figure 9C:
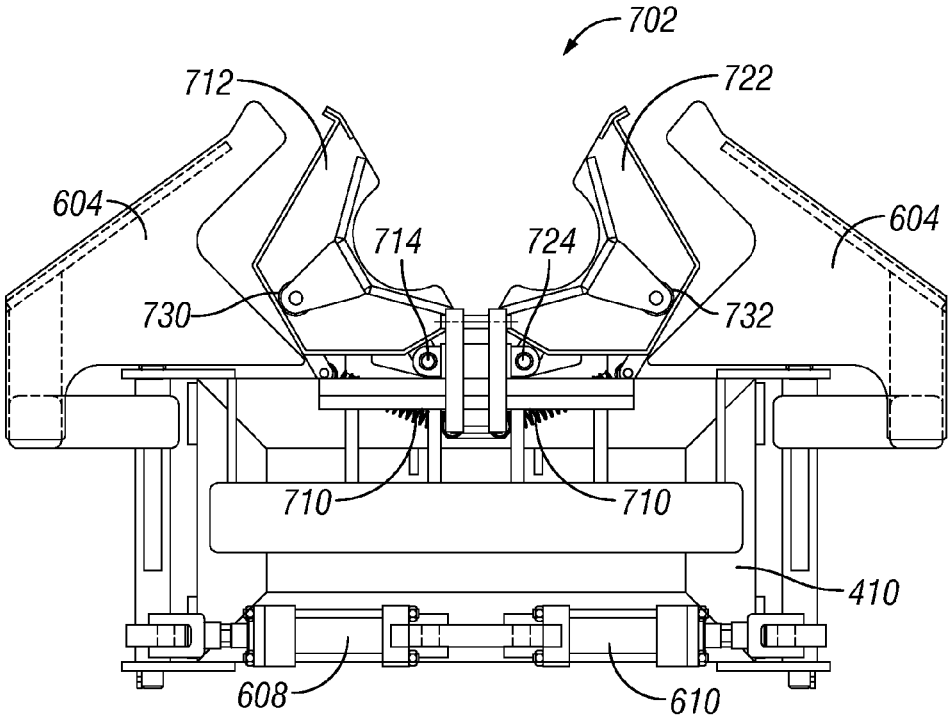
FIG. 9C shows a top view of the stabbing subsystem and the mud bucket subsystem in an open position.

Referring now to FIGS. 9A-9H, embodiments of the system are shown including an isolated combination of the moveable frame system 400, the stabbing system 600 and the mud bucket system 700. Referring first to FIGS. 9A and 9B, the moveable frame system 400 is retractable (FIG. 9A) and extendable (FIG. 9B) relative to the drill string 118 and the pipe joint 158 as previously disclosed. The mud bucket system 700 includes a mud bucket 702 having an exit port 705 at a connection 706 that couples the flexible conduit 704 to the mud bucket 702. A support member 709 and hook 708 are used to suspend the mud bucket 702 from the frame 410. When it is desired to use the mud bucket system 700, such as during break out of the pipe joint 158 when excess mud is present in the pipe joint 158 and must be captured and diverted, the mud bucket system 700 is hooked onto the frame 410 and the moveable frame system 400 is actuated as previously disclosed to extend the system toward the pipe joint 158 and drill string 118 as shown in FIG. 9B. For clarity, in FIG. 9B, the mud bucket 702 is also shown in the still retracted position and isolated from the rest of the system.

Referring briefly back to FIG. 3, the mud bucket system is shown to include the support member 709 and the hook 708 supporting the bucket 702. The connection 706 includes a port 705. A biasing spring 710 couples the support member 709 to the bucket 702. At the top of the bucket 702 are rollers 730. Further operation of the mud bucket system 700 is explained elsewhere herein.

So that the mud bucket system 700 and the stabbing system 600 are positioned about the pipe joint 158 and the drill string 118 as shown in FIG. 9B, these systems are in open positions prior to actuation. Referring to the top view of FIG. 9C, the mud bucket 702 as well as the stabbing jaws 604 are in open positions as shown. The stabbing jaws 604 are spaced apart from a first moveable enclosure portion 712 of the bucket 702 and a second moveable enclosure portion 722 of the bucket 702. The first enclosure portion 712 includes a roller 730 and coupling pivot point 714 and the second enclosure portion 722 includes a roller 732 and coupling pivot point 724. The biasing springs 710 bias the bucket portions to the open position.

Figure 9D:
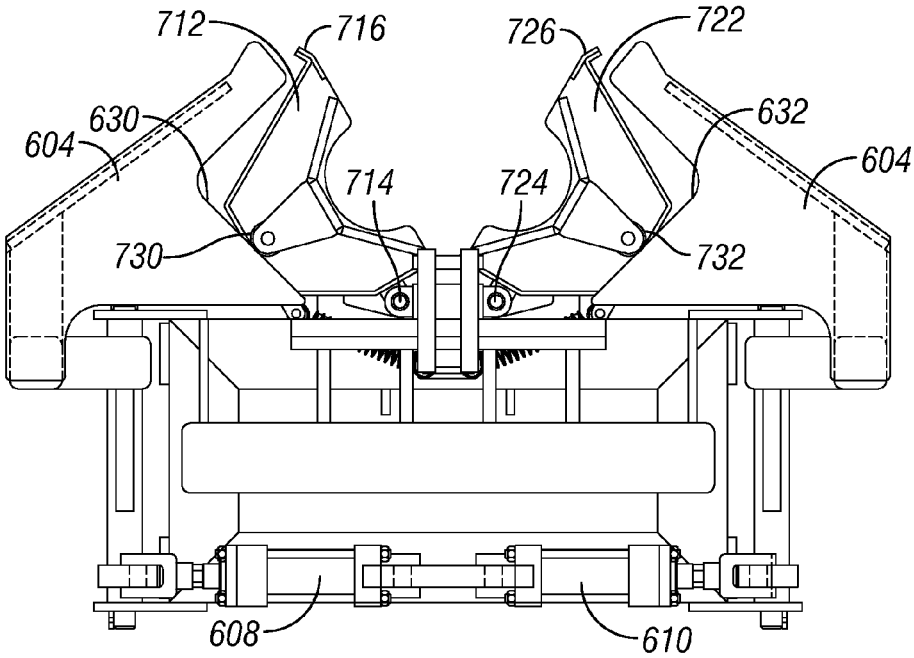
FIG. 9D shows a top view of the stabbing subsystem and the mud bucket subsystem in an intermediate position.
Figure 9E:
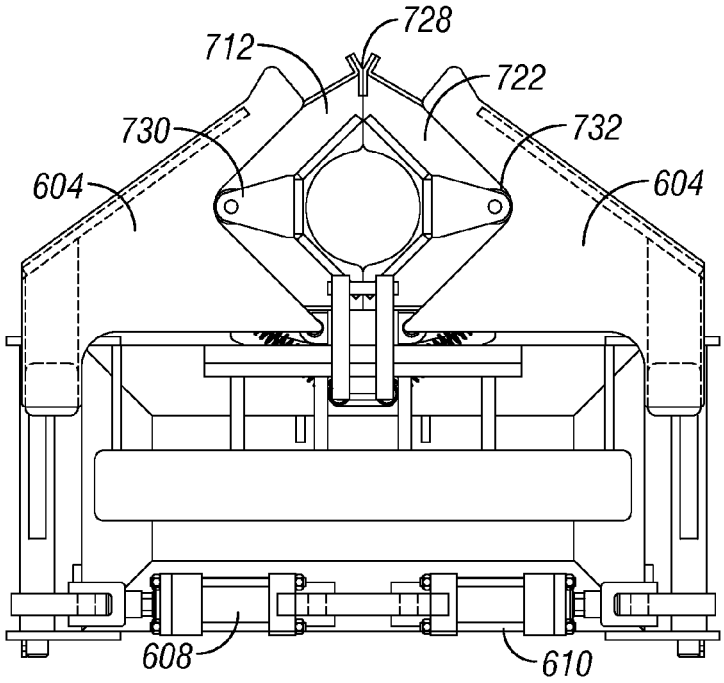
FIG. 9E shows a top view of the stabbing subsystem and the mud bucket subsystem in a closed position.
Figure 9F:
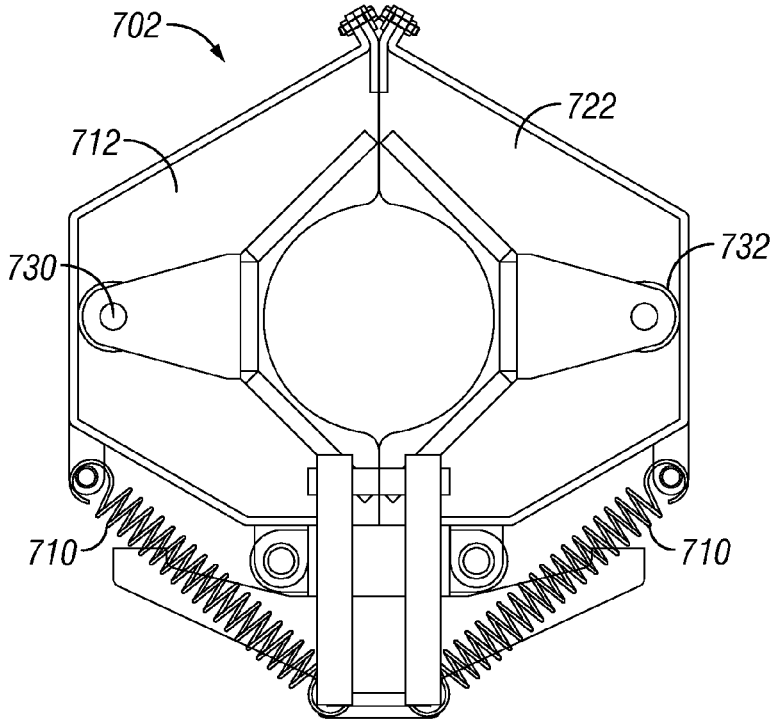
FIG. 9F shows an isolated top view of the mud bucket subsystem of FIG. 9E.

After movement of the stabbing and mud bucket systems to the position of FIG. 9B, the actuators 608, 610 are retracted to move the jaws 604 toward the rollers 730, 732. The jaws 604 include angled guide surfaces 630, 632 to engage the rollers 730, 732, as shown in FIG. 9D. As the jaws 604 continue to move, the rollers 730, 732 roll along the guide surfaces 630, 632 causing the bucket portions 712, 722 to rotate about pivot points 714, 724 and move toward each other. These actions continue until the closed position of FIGS. 9E and 9F are achieved. The first portion 712 includes a contact 716, made of rubber or other elastomeric material, for example, and the second portion 722 includes a contact 726. In the closed position of FIG. 9E, the contacts 716, 726 come together to form a connection 728. Consequently, the mud bucket 702 is closed about a pipe or pipe connection by the stabbing jaws.

Figure 9G:
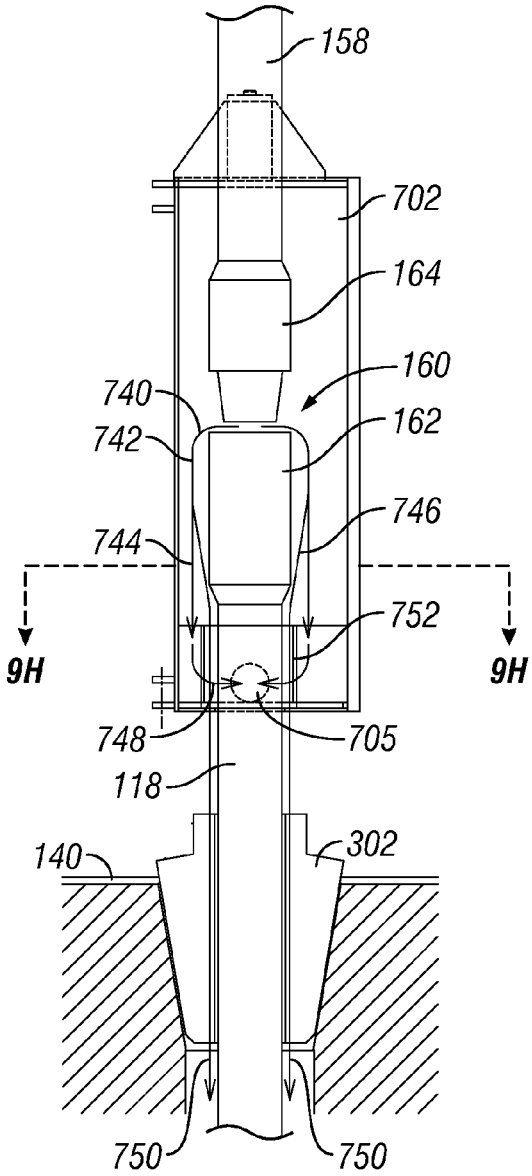
FIG. 9G shows an isolated side view of the mud bucket subsystem closed about a pipe connection, in partial phantom to illustrate a fluid flow in the mud bucket subsystem.
Figure 9H:
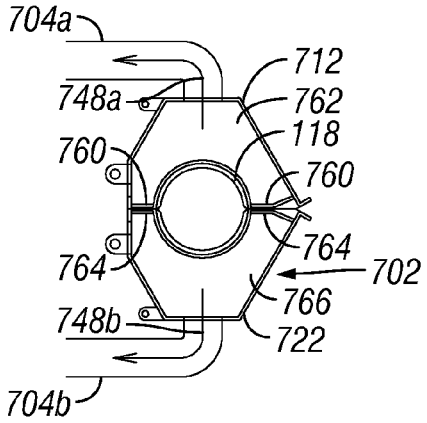
FIG. 9H shows a cross-section view taken at the section A-A of FIG. 9G.

In operation, and referring to FIGS. 9G and 9H, the mud bucket 702 surrounds the pipe connection 160. Upon breakout of the upper pipe joint, such as pipe joint 158, mud will flow at high pressure from the disconnected pipes due to the hydrostatic pressure in the pipe joint 158. The mud will tend to flow outwardly in the general direction of arrow 740. The mud bucket serves to contain this flow, and direct it downwardly generally along arrow 742. Portions of the mud flow are then diverted to either a first flow path 744 or a second flow path 746. A portion of the mud will flow along the first path 744 to a bottom of the bucket along and out the exit port 705, as generally indicated by an arrow 748. The exit port 705 is connected to a vent conduit or tubing 704 as disclosed herein. Another portion of the mud will flow along the second flow path 746 to an opening 752 between the bucket and the pipe 118. The mud will flow around the pipe 118 and the slip 302, and down through the rotary table 140 as generally indicated at arrow 750. In alternative embodiments, a seal may be placed in opening 752 to prevent the flow 750.

Referring now to FIG. 9H, a cross-section taken at line A-A of FIG. 9G is shown. The pipe 118 is surrounded by the bucket 702. The first portion 712 includes a barrier 760 creating a first internal compartment 762. The second portion includes a barrier 764 creating a second internal compartment 766. The compartments 762, 766 separate the bucket 702 into two mud capturing cavities. Consequently, the mud flow at the bottom of the bucket is separated into a first flow 748*a* into the tubing 704*a* and a second flow 748*b* into the tubing 704*b*.

Pipe joints that are broken out contain large hydrostatic heads that create dangerous outward flow of fluids. To contain high pressure mud flows from breakout, very large buckets with seals are typically used. The various embodiments of the mud bucket system 700 can be used to contain substantially all of the high pressure mud flow while also overcoming the limitations of previous mud buckets. Providing multiple mud flow exit paths will efficiently contain the high pressure mud. Further, providing a dual or multiple compartment mud bucket reduces reaction forces, particularly at the bottom of the bucket, that may cause undesirable flex between the two bucket portions. In exemplary embodiments, the mud bucket system 700 is seal-free.

Figure 10B:
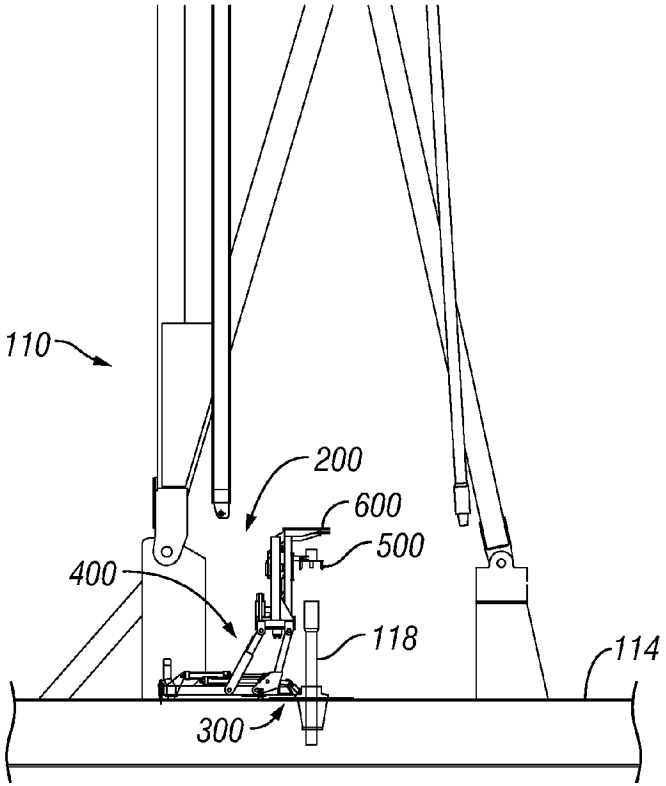
FIG. 10B shows an extended position of the pipe connection system of FIG. 10A with an embodiment of the thread lubricator subsystem activated.
Figure 10A:
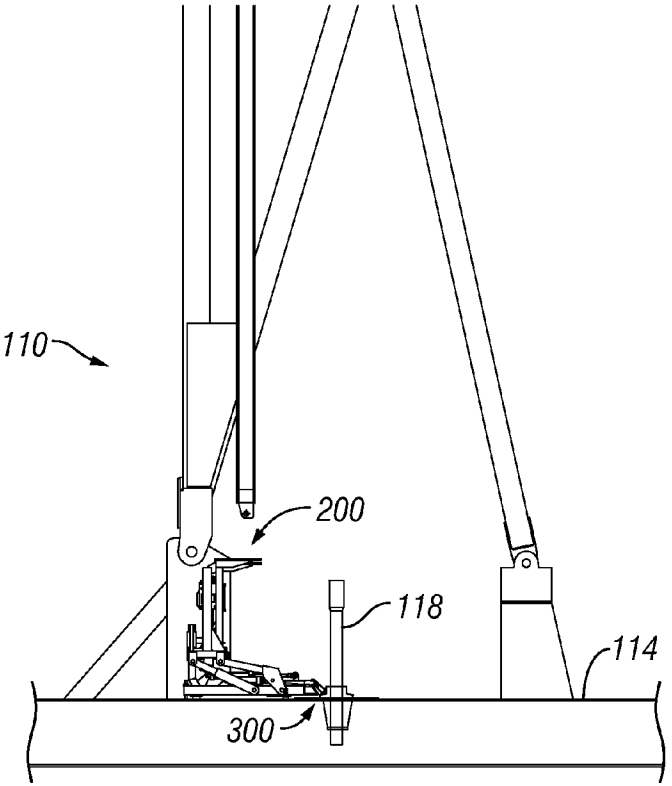
FIG. 10A shows a side elevation view of an embodiment of the pipe connection system in a retracted position on a rig floor.
Figure 10D:
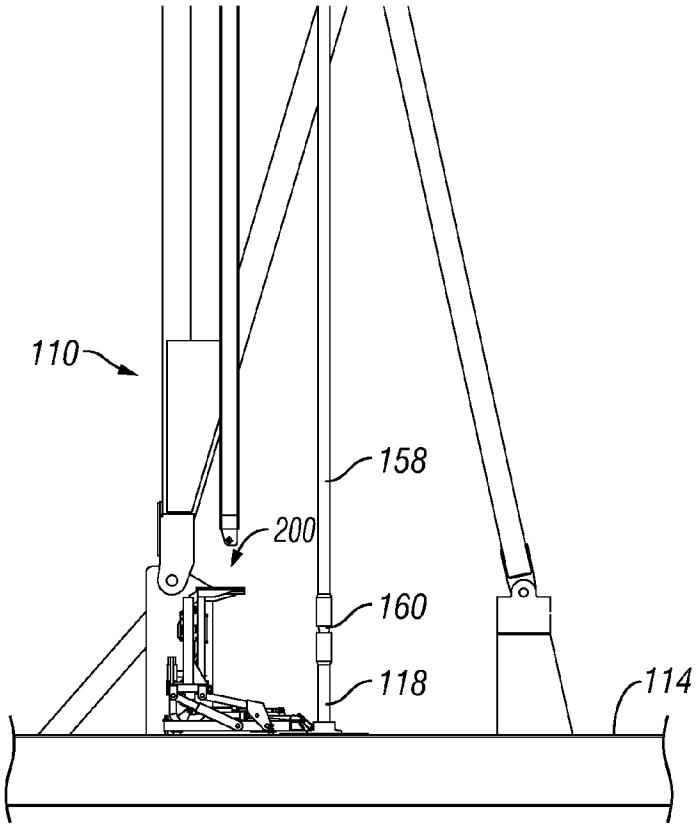
FIG. 10D shows a retracted position of the pipe connection system of FIG. 10A after a pipe connection is made up.
Figure 10C:
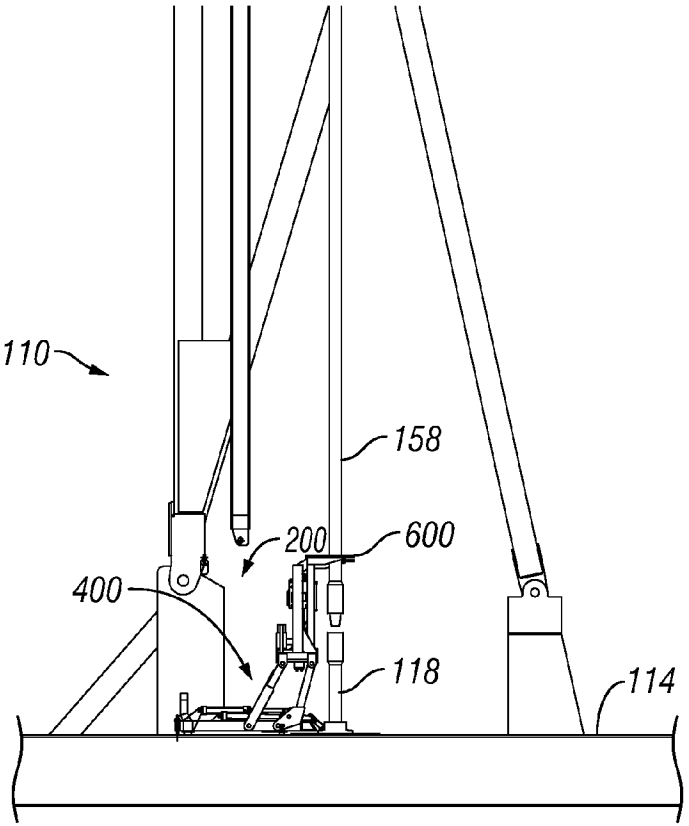
FIG. 10C shows an extended position of the pipe connection system of FIG. 10A with an embodiment of the stabbing subsystem activated.

Referring now to FIGS. 10A-10D, operational embodiments of the pipe connection system are disclosed. In FIG. 10A, a rig 110 includes an embodiment of the pipe connection system 200 disposed on rig floor 114. The upper portions of the system 200 are retracted relative to the drill string 118, while the slip control system 300 is extended to engage the slip wedge with the drill string. If a pipe joint is to be made up with the drill string, the connection end of the drill string may require a dosing of pipe dope. As shown in FIG. 9B, the system is extended via moveable frame system 400 to place thread lubricator 500 adjacent the drill string 118. The thread lubricator 500 is extended, and lowered if necessary, to treat with pipe dope the connection end of the drill string 118 as disclosed herein. The thread lubricator is then retracted. Next, as shown in FIG. 10C, the stabbing system 600 is actuated to engage and manipulate the pipe joint 158 for makeup with the drill string 118. After makeup, as shown in FIG. 9D, the upper portions of the system 200 are retracted. The slip control system may also be retracted as disclosed herein. Further, in some embodiments, the mud bucket is employed during breakout of the pipe joint 158. In a similar arrangement as seen in FIG. 10C, the mud bucket 702 is attached to the system 200 and is disposed adjacent the pipe connection, with the stabbing system instead used in closing the mud bucket about the pipe connection and receiving the pipe joint 158 for breakout.

In other embodiments of the system 200 just described, the slip control system 300 may not be included in a system delivered to a rig floor because many existing rig floors include manual slip control systems already in place. The modular system 200 is easily adapted to accommodate such an existing slip control system.

Various combinations of the systems, subsystems, and components disclosed herein are contemplated. The systems described herein are modular, such that the subsystems can be mixed and matched in various arrangements to achieve different functionalities while limiting the spaced used by the overall system. Further, the systems, subsystems, and components described here are substantially automated, limiting rig crew interaction with the various embodiments described herein and increasing crew safety. The systems can be used with a variety of oilfield tubulars, including drill pipe, drill collars, casing, and tubing.

While specific embodiments have been shown and described, modifications can be made by one skilled in the art without departing from the spirit or teaching of this disclosure. The embodiments as described are exemplary only and are not limiting. Many variations and modifications are possible and are within the scope of the disclosure. Accordingly, the scope of protection is not limited to the embodiments described, but is only limited by the claims that follow, the scope of which shall include all equivalents of the subject matter of the claims.

What is claimed is:

1. A pipe connection system comprising:

a stationary support frame;

a moveable support frame coupled to the stationary support frame and moveable between a refracted position and an extended position; and a pair of stabbing arms coupled at pivot points to the moveable support frame and moveable between an open position and a closed position by at least one actuator operable to rotate the stabbing arms about the pivot points.

2. The pipe connection system of claim 1 wherein the stabbing arms are moveable between the open position and the closed position about a pipe joint.

3. The pipe connection system of claim 2 wherein the stabbing arms include stabbing jaws having angled surfaces for surrounding and engaging the pipe joint.

4. The pipe connection system of claim 1 further comprising a pair of actuators each coupling one of the stabbing arms to the moveable support frame.

5. The pipe connection system of claim 1 further comprising a pipe thread lubricator coupled to the moveable support frame.

6. The pipe connection system of claim 5 wherein the pipe thread lubricator is moveable between a refracted position and an extended position adjacent a pipe thread of a downhole tubular string.

7. The pipe connection system of claim 5 further comprising a pivot arm and a pivot arm actuator operable to move the pipe thread lubricator horizontally relative to the moveable support frame.

8. The pipe connection system of claim 1 further comprising a mud bucket coupled to the moveable support frame.

9. The pipe connection system of claim 8 wherein the mud bucket is moveable between an open position and a closed position about a pipe connection.

10. The pipe connection system of claim 9 wherein the mud bucket includes at least two internal compartments separately receiving fluid from the pipe connection in the closed position.

11. A pipe connection system comprising:

a stationary support frame;

a moveable support frame coupled to the stationary support frame and moveable between a refracted position and an extended position;

a stabbing system coupled to the moveable support frame and moveable between an open position and a closed position; and a pair of pivoting support arms coupling the moveable support frame to the stationary support frame.

12. The pipe connection system of claim 11 further comprising an actuator coupled between at least one of the pivoting support arms and the stationary support frame, wherein the actuator is operable to rotate the pivoting support arm.

13. A pipe connection system comprising:

a stationary support frame;

a moveable support frame coupled to the stationary support frame and moveable between a refracted position and an extended position;

a stabbing system coupled to the moveable support frame and moveable between an open position and a closed position; and a slip control system coupled to the stationary support frame including:

a slip wedge; and at least one actuator coupled between the slip wedge and the stationary support frame, wherein the actuator is operable to move the slip wedge between a refracted position and an extended position in engagement with a downhole tubular string.

14. The pipe connection system of claim 13 wherein the actuator is a hydraulic piston and cylinder arrangement.

15. The pipe connection system of claim 13 further comprising:

a first actuator coupled to the stationary support frame; and a support member coupled to the first actuator and slidably engaged with the slip wedge.

16. The pipe connection system of claim 15 further comprising:

an articulated arm coupled between the slip wedge and the stationary support frame; and a second actuator coupled between the articulated arm and the stationary support frame, wherein the second actuator is operable to rotate the articulated arm.

17. A pipe connection system comprising:

a stationary support frame;

a moveable support frame coupled to the stationary support frame and moveable between a refracted position and an extended position;

a stabbing system coupled to the moveable support frame and moveable between an open position and a closed position;

a pipe thread lubricator coupled to the moveable support frame; and a dolly and a dolly actuator operable to move the pipe thread lubricator vertically relative to the moveable support frame.

18. A pipe connection system comprising:

a stationary support frame;

a moveable support frame coupled to the stationary support frame and moveable between a refracted position and an extended position;

a pair of stabbing arms coupled to the moveable support frame and moveable between an open position and a closed position;

a mud bucket coupled to the moveable support frame, wherein the mud bucket is moveable between an open position and a closed position about a pipe connection; and wherein the stabbing arms are operable to engage and move the mud bucket between the open and closed positions.

19. A pipe connection system comprising:

a stationary support frame;

a moveable support frame coupled to the stationary support frame and moveable between a refracted position and an extended position;

a stabbing system coupled to the moveable support frame and moveable between an open position and a closed position;

a mud bucket coupled to the moveable support frame, wherein the mud bucket is moveable between an open position and a closed position about a pipe connection; and wherein the mud bucket includes a first fluid exit path and a second fluid exit path in the closed position.

20. The pipe connection system of claim 19 wherein the first fluid exit path includes a vent tube and the second fluid exit path includes an opening at the bottom of the bucket.

21. A pipe connection system comprising:

a stationary support frame;

a moveable support frame coupled to the stationary support frame and moveable between a refracted position and an extended position;

a stabbing system coupled to the moveable support frame and moveable between an open position and a closed position; and a mud bucket coupled to the moveable support frame, wherein the mud bucket further comprises:

a first enclosure portion and a second enclosure portion, wherein the enclosure portions are moveable from an open position to receive a pipe connection to a closed position to surround the pipe connection;

a first exit flow path to communicate mud in the closed position comprising an exit port and a vent conduit; and a second exit flow path to communicate mud in the closed position comprising an opening in at least one of the enclosure portions.

22. The mud bucket of claim 21 wherein the opening extends through a bottom of the closed first and second enclosure portions.

23. The mud bucket of claim 21 further comprising:

a first compartment in the first enclosure portion; and a second compartment in the second enclosure portion separate from the first compartment.

24. The mud bucket of claim 21 wherein:

wherein the first and second enclosure portions receive the stabbing arms; and wherein the stabbing arms are operable to move the enclosure portions from the open position to the closed position.

25. The mud bucket of claim 21 wherein the first and second enclosure portions are seal-free in the closed position.

26. A pipe connection system comprising:

a stationary support frame coupled to a rig floor;

a slip control subsystem coupled to the stationary support frame, the slip control subsystem including a slip wedge moveable between a refracted position and an extended position in engagement with a portion of the rig floor and a downhole tubular string;

a support frame subsystem moveably coupled to the stationary support frame;

a stabbing arm subsystem moveably coupled to the moveable support frame subsystem;

a thread lubricator subsystem moveably coupled to the moveable support frame subsystem; and a mud bucket subsystem moveably coupled to the moveable support frame subsystem.

27. The pipe connection system of claim 26 wherein each of the subsystems is a modular component removeable from the system.

28. The pipe connection system of claim 26 wherein each of the subsystems includes an actuator for automated movement of the subsystem.

29. A method for connecting a pipe joint to a downhole tubular string comprising:

providing a pipe connection system on a rig floor adjacent the tubular string;

extending a slip wedge of the pipe connection system into secured engagement with a portion of the rig floor and the tubular string;

extending a support frame subsystem of the pipe connection system into a position adjacent the tubular string;

positioning the pipe joint adjacent the tubular string;

closing a pair of stabbing arms on the support frame subsystem about the pipe joint; and making up the pipe joint with the tubular string.

30. The method of claim 29 further comprising:

prior to positioning the pipe joint adjacent the tubular string, extending a thread lubricator subsystem on the support frame subsystem into a position adjacent a pipe thread of the tubular string and lubricating the pipe thread.

31. The method of claim 29 further comprising:

opening the stabbing arms;

retracting the support frame subsystem;

retracting the slip wedge; and operating the tubular string with the made up pipe joint.

32. The method of claim 31 further comprising:

re-extending the support frame subsystem;

closing a mud bucket subsystem on the support frame subsystem about a pipe connection by re-closing the pair of stabbing arms; and using the closed mud bucket subsystem to capture and direct a fluid from the pipe connection during disconnection of a pipe joint.

* * * * *